US008408422B2

(12) United States Patent
Leleu

(10) Patent No.: US 8,408,422 B2
(45) Date of Patent: Apr. 2, 2013

(54) DEVICE FOR FASTENING A DISPENSING PUMP ON A BOTTLE CONTAINING A PRODUCT

(75) Inventor: Frederic Leleu, Dieppe (FR)

(73) Assignee: Rexam Dispensing Systems S.A.S. (FR)

( * ) Notice: Subject to any disclaimer, the term of this patent is extended or adjusted under 35 U.S.C. 154(b) by 279 days.

(21) Appl. No.: 12/699,707

(22) Filed: Feb. 3, 2010
(Under 37 CFR 1.47)

(65) Prior Publication Data

US 2011/0031281 A1 Feb. 10, 2011

(51) Int. Cl.
*B67B 1/00* (2006.01)

(52) U.S. Cl. ..... 222/153.09; 222/320

(58) Field of Classification Search ..... 222/153.09, 222/153.1, 320–321.9, 372, 383.1
See application file for complete search history.

(56) References Cited

U.S. PATENT DOCUMENTS

| | | | | |
|---|---|---|---|---|
| 4,346,821 | A * | 8/1982 | Wesner et al. | 222/153.02 |
| 4,366,921 | A * | 1/1983 | Kirk, Jr. | 222/153.09 |
| 6,695,171 | B2 * | 2/2004 | Walters et al. | 222/153.13 |
| 2009/0283549 | A1 * | 11/2009 | Beranger | 222/321.7 |
| 2011/0240679 | A1 * | 10/2011 | Langlos | 222/321.7 |

FOREIGN PATENT DOCUMENTS

WO 2007042701 A1 4/2007

* cited by examiner

*Primary Examiner* — Kevin P Shaver
*Assistant Examiner* — Patrick M Buechner
(74) *Attorney, Agent, or Firm* — St. Onge Steward Johnston & Reens, LLC

(57) ABSTRACT

A device for fastening a dispensing pump on a bottle containing a product, a sleeve fastening the pump and fastening on the bottle, a dressing hoop intended to be mounted by axial sliding around a peripheral seating of the sleeve, the peripheral seating having axial splines and the internal wall of the hoop having axial ribs which are arranged to be placed in the splines during the mounting of the hoop around the seating.

9 Claims, 3 Drawing Sheets

DEVICE FOR FASTENING A DISPENSING PUMP ON A BOTTLE CONTAINING A PRODUCT

FIELD OF THE INVENTION

The invention relates to a device for fastening a dispensing pump on a bottle containing a product, as well as to a dispensing bottle wherein the pump is fastened by the intermediary of such a device.

BACKGROUND OF THE INVENTION

In particular, the bottle allows for the packaging and the dispensing of a fluid product, in particular of a liquid or of a cream, for example a perfume, a cosmetic product or a pharmaceutical product.

Such bottles are known comprising a body defining a reservoir for packaging the product, a neck overmounting said body by defining an upper opening for said reservoir, and a pump mounted in said upper opening by positioning the means of supplying said pump inside said reservoir. As such, the pump makes it possible to restore the product packaged in the reservoir.

In order to provide the positioning and the fastening of the pump in relation to the body, the use of a sleeve is known having on the one hand, means of fastening the pump and on the other hand, means of fastening the sleeve on the neck.

Furthermore, this sleeve can be dressed by means of a hoop in order to improve the aesthetics of the bottle. In particular, the dressing hoop can be mounted by axial sliding around a peripheral seating of the sleeve.

In this embodiment, the problem arises of the reliability of the mounting of the hoop on the sleeve, in particular relatively to the stresses applied on the hoop in the axial direction and/or in rotation. Furthermore, in the case of a reversible fastening of the pump on the bottle, this problem is even more critical as the dismounting of the pump is carried out by manually actuating the means of fastening by the intermediary of the hoop.

SUMMARY OF THE INVENTION

In order to overcome this problem, the document WO-2007/042701 proposes a device for fastening comprising on the one hand, a sleeve of which the peripheral seating to be dressed is smooth and on the other hand, a hoop having elongated ribs formed of several projections separated by cavities. As such, by providing that the ribs delimit an inside diameter which is less than the outside diameter of the smooth seating, said ribs are inlayed in the sleeve during the mounting.

However, the inlaying induces a plastic deformation of the sleeve which can in particular be passed on to the means of fastening. As such, the improvement of the aesthetics by means of the hoop can result in a decrease in the reliability of the fastening of the pump on the bottle, in particular relatively to the seal that this fastening must provide.

Furthermore, the mounting of the hoop requires the application of a force that is sufficient in order to realise the inlaying, which can result in an alteration of the aesthetics of the hoop.

The invention aims to perfect the prior art by proposing in particular a device for fastening a dispensing pump on a bottle, said device procuring advantageous aesthetics by limiting the mechanical stresses induced by its mounting.

To this effect, and according to a first aspect, the invention proposes a device for fastening a dispensing pump on a bottle containing a product, said device comprising a sleeve having means of fastening the pump and means of fastening on said bottle, said device further comprising a dressing hoop intended to be mounted by axial sliding around a peripheral seating of the sleeve, the peripheral seating having axial splines and the internal wall of the hoop having axial ribs which are arranged in order to be positioned in said splines during the mounting of said hoop around said seating.

According to a second aspect, the invention proposes a dispensing bottle comprising a body defining a reservoir for the packaging of a product, a neck overmounting said body by defining an upper opening for said reservoir, and a pump mounted in said upper opening by positioning the means of supplying of said pump inside said reservoir, said bottle further comprising such a device for fastening, the pump being fastened to the sleeve which is fastened on the neck, the hoop being mounted around the peripheral seating with the ribs arranged in the splines.

BRIEF DESCRIPTION OF THE DRAWINGS

Other objects and advantages of the invention shall appear in the description which follows, made in reference to the annexed figures wherein.

DETAILED DESCRIPTION OF THE INVENTION

Figure 1A:
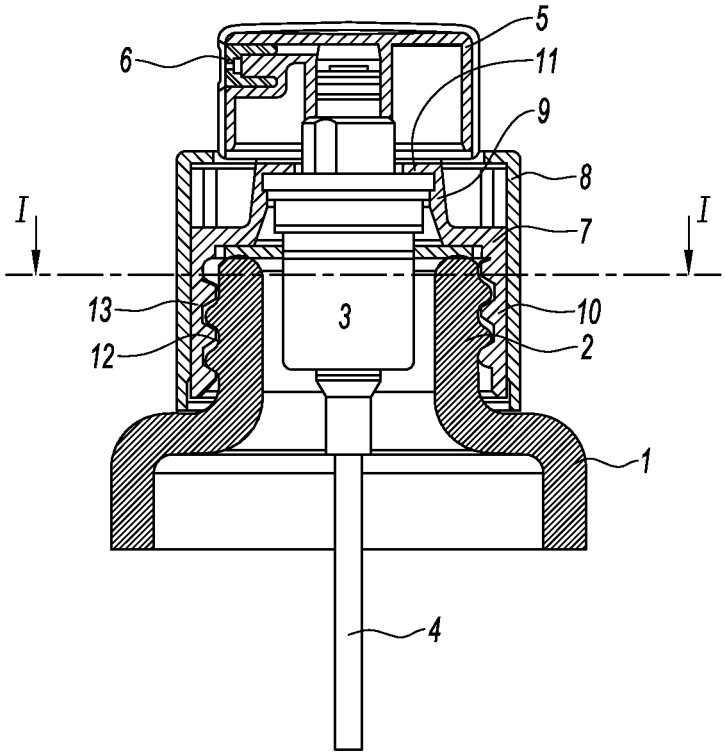
FIG. 1 show a dispensing bottle according to a first embodiment of the invention, respectively of a partial longitudinal section (FIG. 1*a*) and of a transversal section according to the line I-I (FIG. 1*b*)

In relation with the figures, a bottle is described hereinbelow intended to contain a fluid product in order to dispense it. In particular examples, the product can be a liquid or a cream, for example a perfume, a cosmetic product or a pharmaceutical product.

The bottle can be formed from rigid material, in particular from glass or from plastic material, in order to include a body 1 defining a reservoir for packaging the product. The body 1 is overmounted by a neck 2 formed of a single part with said body by defining an upper opening for said reservoir.

The dispensing bottle further comprises a pump 3 mounted in the upper opening by positioning the means of supplying of said pump inside the reservoir. The pump shown comprises a body of which the periphery is mounted without clamping in the opening.

The body has a lower portion which is provided with a supplying orifice, the means of supplying comprising a dip tube 4 having an upper portion fixed in the orifice and a lower portion arranged against the bottom of the reservoir.

Moreover, the pump comprises a push-button 5 provided with a dispensing orifice 6. According to a known embodiment, the button 5 actuates in reversible translation a nozzle on a dispensing course and a piston is also mounted on the nozzle between a state of sealing and a state of supplying the orifices of said nozzle. However, the invention is not limited to a particular embodiment of the pump 3.

In order to provide for the positioning and the fastening of the pump 3 in relation to body 1, the bottle further comprises a device for fastening said pump on the neck of said bottle, said device comprising a sleeve 7 which can be made in a single piece from ductile material, in particular from plastic material of the polyolefin type.

The device for fastening further comprises a dressing hoop 8 of the sleeve 7, in particular arranged to mask the neck portion of the bottle, said hoop can be made from rigid material such as metal, for example aluminium, in order to have advantageous aesthetics. In the embodiments shown, the hoop 8 has a cylindrical geometry of revolution which extends axially over a length which is sufficient to provide for its masking function.

The sleeve 7 has means of fastening of the pump and means of fastening on the neck 2. In the embodiments shown, the sleeve 7 has a geometry of revolution formed by an upper crown 9 whereunder extends a lower skirt 10, the outside diameter of the crown 9 being less than that of the skirt 10.

The crown 9 forms a housing 11 wherein the body of the pump 3 is fastened to the sleeve 7 by snapping, the fastening of the sleeve 7—pump 3 unit on the bottle being carried out by screwing. For this, the outside of the neck 2 and the inside of the skirt 10 are provided with a complementary screw thread 12. However, the invention is not limited to such an embodiment for the fastening of the sleeve 7 on the neck 2. In particular, a fastening by snapping of the sleeve 7 on the neck 2 can be used. Likewise, the invention is not limited to such an embodiment for the fastening of the body of the pump 3 to the sleeve 7.

In order to provide for its dressing function, the hoop 8 is intended to be mounted by axial sliding around a peripheral seating 13 of the sleeve 7. In the figures, the peripheral seating 13 is annular and extends on the outside periphery of the skirt 10. In particular, the peripheral seating 13 therefore extends around the screw thread 12 which is formed on the inside of the skirt 10.

The peripheral seating 13 has axial splines 14 which are separated by bridges of material 15. In particular, the splines 14 include a bottom with a cavity which is delimited on the seating 13 between two projecting edges, the bridges of material 15 being delimited by an edge of respectively two adjacent splines 14. As such, the bridges of material 15 form an inscribed diameter which is greater than that formed by the bottom of the splines 14.

In the embodiments shown, the splines 14 extend axially over the entire exterior of the skirt 10 in such a way as to exit in the upper portion and in the lower portion of the latter.

Moreover, the internal wall of the hoop 8 has axial ribs 16 which are arranged to be positioned in the splines 14 during the mounting of said hoop around the seating 13. As such, the splines 14 being preformed on the seating 13, the mounting does not require an inlaying of the ribs 16 but a simple sliding. As such, in particular in the case where the seating 13 extends around means of fastening, a possible deformation of the latter is avoided during the mounting.

Furthermore, the engagement of the ribs 16 in the splines 14 provides for the maintaining in rotation of the hoop 8 relatively to the sleeve 7, in particular during the unscrewing of the pump 3. In particular, in order to combine the sliding without deformation and the maintaining in rotation, the inscribed diameter formed by the ribs 16 can be substantially identical to that formed by the bottoms of the splines 14, or very slightly less in order to ensure via friction an axial retention of the hoop 8 on the sleeve 7.

The hoop 8 can be arranged to be mounted with axial clamping on the sleeve 7, in such a way as to render reliable the fastening of the hoop 8 on the sleeve 7 relatively to the axial forces. In particular, the internal wall of the hoop 8 can be arranged, in particular relatively to its internal nominal diameter, in order to ensure the axial clamping via interaction with the bridges of material 15.

Moreover, in the case of a sleeve 7 snapped on the neck 2, the axial clamping of the hoop 8 can ensure a rendering reliable of said snapping by radially retaining the means of snapping on.

According to another embodiment, the fastening of the pump 3 can be carried out by means of a sleeve 7 comprising a deformable skirt between a mounting configuration wherein said skirt can be positioned around the neck 2 and a clamping configuration of said skirt around said neck in order to provide for the fastening. In particular, the clamping configuration can be obtained by the mounting of the hoop 8 on the sleeve 7.

Moreover, the hoop 8 and/or the sleeve 7 can comprise means of axial fastening of said hoop around said sleeve. In the FIG. 2, the sleeve 7 comprises a snap ring 17 intended to be arranged in a corresponding groove 18 of the hoop 8.

More precisely, the ring 17 is formed on a second skirt 19 of the sleeve 7 which surrounds the peripheral seating 13. The hoop 8 further comprises two skirts, an inside skirt 8*a* bearing the ribs 16 and an outside skirt 8*b* bearing the groove 18.

Figure 1B:
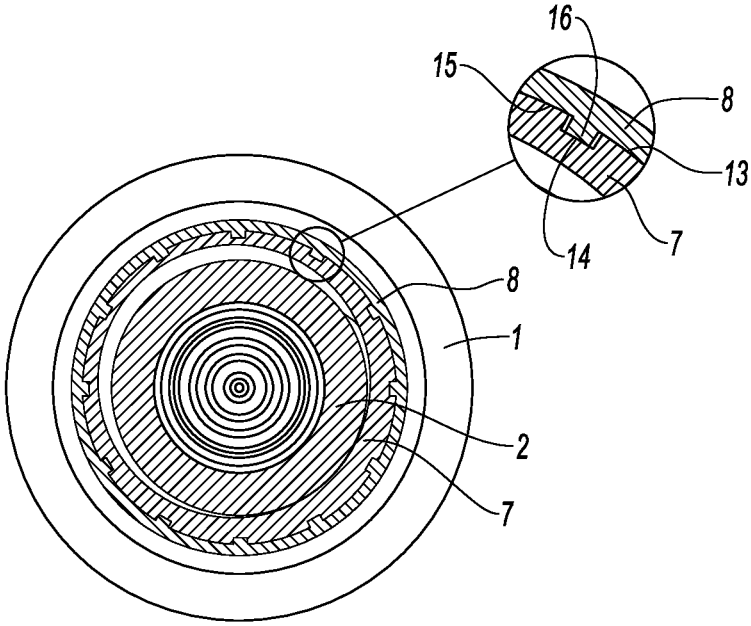
Figure 2A:
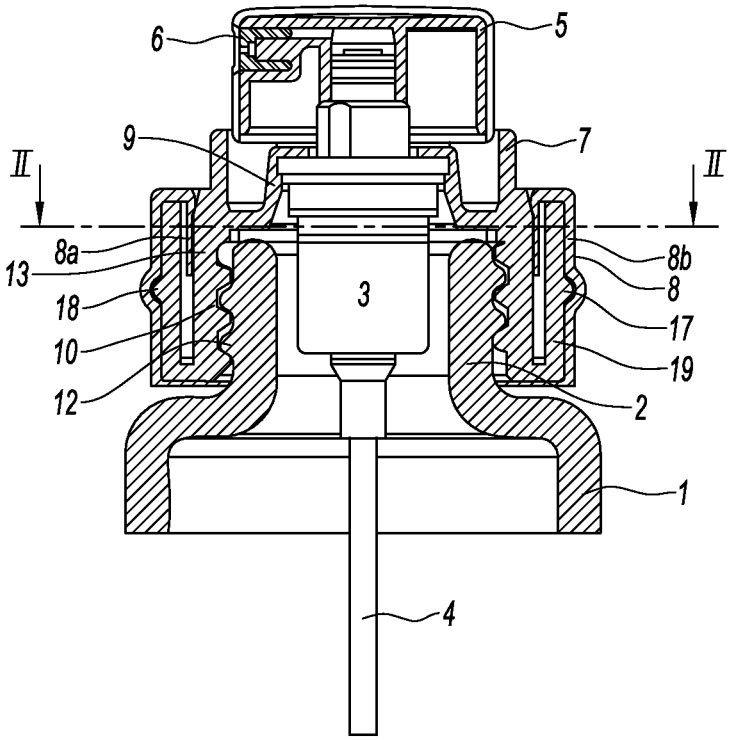
FIG. 2 show a dispensing bottle according to a second embodiment of the invention, respectively of a partial longitudinal section (FIG. 2*a*) and of a transversal section according to the line II-II (FIG. 2*b*)
Figure 2B:
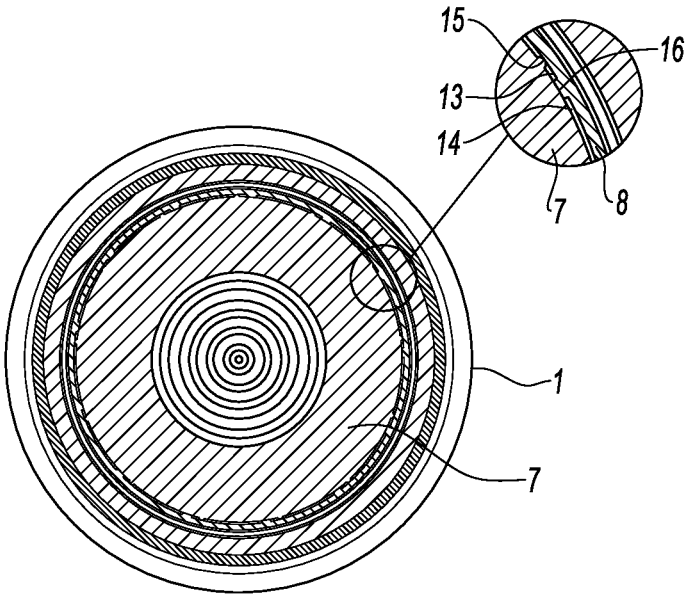
Figure 3:
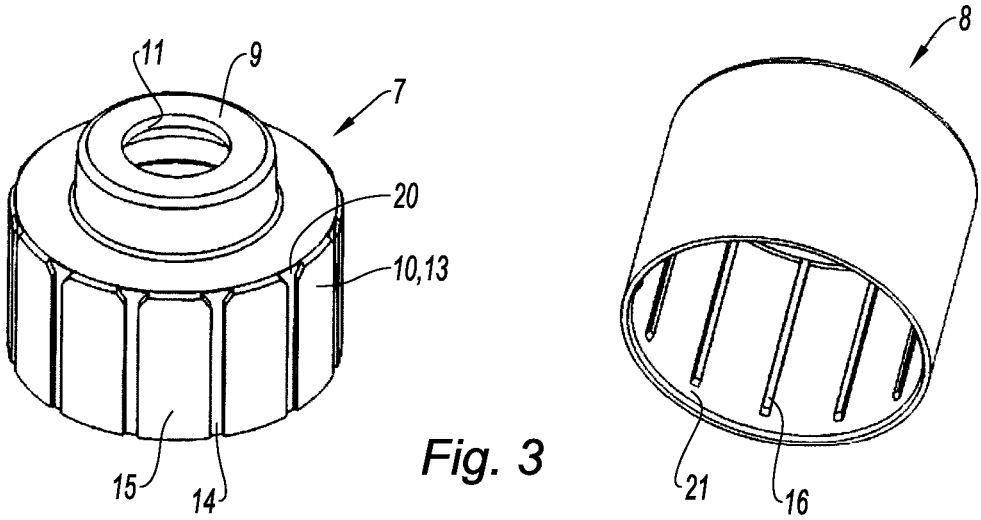
FIG. 3 is a perspective representation showing the sleeve and the hoop of a device for fastening according to an embodiment of the invention.

In relation with FIGS. 1 to 3, the ribs 16 are elongated and have a rectangular section, the number of said ribs being complementary to that of the splines 14. Furthermore, as shown in particular in the enlargement in FIG. 1*b*, the geometry of the ribs 16 is complementary to that of the splines 14, with a slight lateral clearance on both sides in order to facilitate the sliding. In the enlargement in FIG. 2*b*, the width of the splines 14 is greater than that of the ribs 16.

Figure 4:
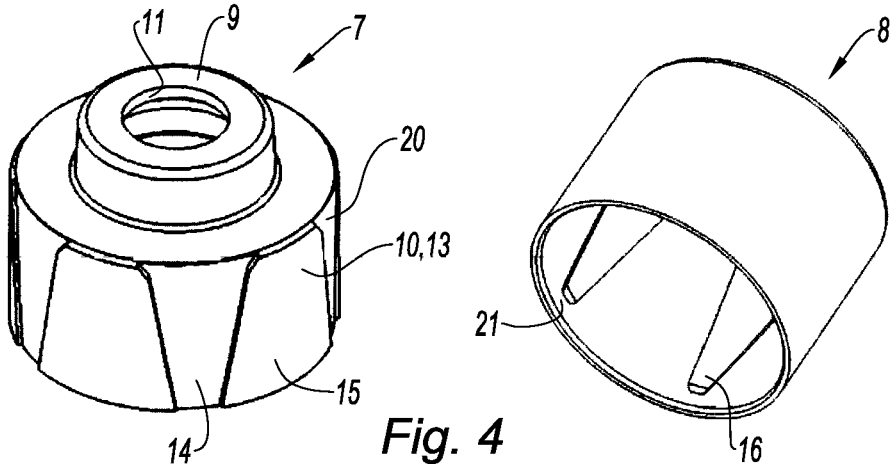
FIG. 4 is a perspective representation showing the sleeve and the hoop of a device for fastening according to an embodiment of the invention.
Figure 5:
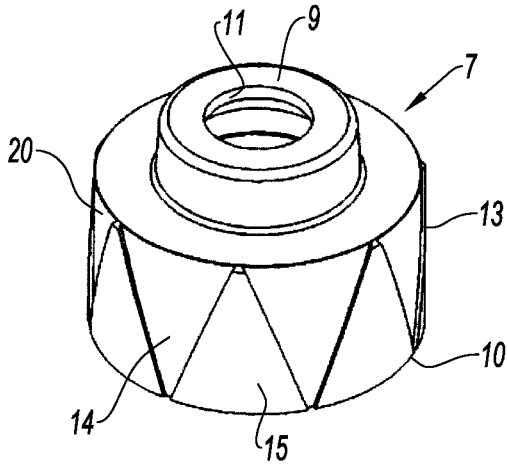
FIG. 5 is a perspective representation of a sleeve according to an alternative of the embodiment shown in FIG. 4.

Moreover, FIGS. 3 to 5 show splines 14 which have an upper chamfer 20 arranged to facilitate the entry of the ribs 16 into said splines during the mounting. Furthermore, still to facilitate mounting, the internal wall of the hoop 8 has a lower portion 21 whereon the ribs 16 do not extend.

In the FIGS. 4 and 5, the splines 14 as well as the ribs 16 have a converging profile in the direction of sliding. As such, by enlarging the entry chamfer 20, the angular orientation of the hoop 8 is facilitated in relation to sleeve 7 in terms of mounting. In FIG. 5, this enlargement is maximised by providing that the splines 14 and the bridges of material 15 form an alternating succession of triangles arranged head-to-tail.

What is claimed is:

1. A device for fastening a dispensing pump on a bottle containing a product, said device comprising a sleeve having means of fastening of the pump and means of fastening on said bottle, said device further comprising a dressing hoop intended to be mounted by axial sliding around a peripheral seating of the sleeve, said device being characterised in that the peripheral seating has axial splines and in that an internal wall of the hoop has axial ribs which are arranged in order to be positioned in said splines during the mounting of said hoop around said seating, wherein the hoop is arranged to be mounted with axial clamping on the sleeve, and wherein an internal nominal diameter of the internal wall of the hoop between the axial ribs is arranged in order to ensure the axial clamping via axial interaction of the internal nominal diameter of the internal wall of the hoop between the axial ribs with bridges of material that separate the splines.

2. The device for fastening according to claim 1, characterised in that the peripheral seating extends around the means of fastening of the sleeve on the bottle.

3. The device for fastening according to claim 1, characterised in that the sleeve has a lower skirt on the outside of which extends the peripheral seating.

4. The device for fastening according to claim 1, characterised in that the means of fastening include a screw thread.

5. The device for fastening according to claim 1, characterised in that the splines have an upper chamfer which is arranged to facilitate the entry of the ribs into said splines during the mounting.

6. The device for fastening according to claim 1, characterised in that the splines have a converging profile in the direction of sliding.

7. The device for fastening according to claim 1, characterised in that the geometry of the ribs is complementary to that of the splines.

8. The device for fastening according to claim 1, characterised in that at least one of the hoop and the sleeve comprises means of axial fastening of said hoop around said sleeve.

9. A dispensing bottle comprising a body defining a reservoir for the packaging of a product, a neck overmounting said body by defining an upper opening for said reservoir, and a pump mounted in said upper opening by positioning the means of supplying of said pump inside said reservoir, said bottle further comprising a device for fastening according to claim 1, the pump being fastened to the sleeve which is fastened on the neck, the hoop being mounted around the peripheral seating with the ribs arranged in the splines.

* * * * *